US007934788B2

(12) United States Patent
Matsumura

(10) Patent No.: US 7,934,788 B2
(45) Date of Patent: May 3, 2011

(54) INKJET PRINTING APPARATUS AND CONTROL METHOD FOR THE APPARATUS

(75) Inventor: Hideaki Matsumura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 143 days.

(21) Appl. No.: 12/031,102

(22) Filed: Feb. 14, 2008

(65) Prior Publication Data

US 2008/0198195 A1 Aug. 21, 2008

(30) Foreign Application Priority Data

Feb. 16, 2007 (JP) ..... 2007-036803

(51) Int. Cl.
*B41J 29/38* (2006.01)

(52) U.S. Cl. ..... 347/16

(58) Field of Classification Search ..... None
See application file for complete search history.

(56) References Cited

U.S. PATENT DOCUMENTS

2007/0085891 A1* 4/2007 Batalla et al. ..... 347/104

FOREIGN PATENT DOCUMENTS

JP 08-282027 10/1996
JP 2005-007817 1/2005

OTHER PUBLICATIONS

Machine translation of the claims and detailed description of JP 2005-007817 A.*
Translation of JP 2005-007817 A.*

* cited by examiner

*Primary Examiner* — Matthew Luu
*Assistant Examiner* — Justin Seo
(74) *Attorney, Agent, or Firm* — Fitzpatrick, Cella, Harper & Scinto

(57) ABSTRACT

A serial inkjet printing apparatus is capable of stably printing a preferable image, when a printing medium is released and conveyed from an upstream conveying unit, and when the printing medium is conveyed by only a downstream conveying unit. Specifically, the serial inkjet printing apparatus, which includes the upstream conveying unit and the downstream conveying unit, corrects a conveyance amount of the printing medium by predicting a shift of a printing position due to expansion or contraction of the printing medium, when the printing medium is released and conveyed from the upstream conveying unit, and when the printing medium is conveyed by only the downstream conveying unit.

8 Claims, 17 Drawing Sheets

| PRINTING MEDIUM | TEMPERATURE -HUMIDITY REGION (℃/%) | PRINTING REGION B | | PRINTING REGION C | |
|---|---|---|---|---|---|
| | | CORRECTION VALUE FOR 288 NOZZLES (9600dpi) | | CORRECTION VALUE FOR 1280 NOZZLES (9600dpi) | |
| | | DEFAULT VALUE | OFFSET VALUE | DEFAULT VALUE | OFFSET VALUE |
| PHOTO GLOSSY MEDIUM | 14℃ OR BELOW/ 39% OR BELOW | -16 | 0 | -60 | 0 |
| | 15℃ ~ 25℃ 40℃ ~ 60℃ | | 0 | | 0 |
| | 26℃ OR ABOVE/ 61% OR ABOVE | | 0 | | 0 |
| GLOSSY MEDIUM | 14℃ OR BELOW/ 39% OR BELOW | -16 | 10 | -60 | 25 |
| | 15℃ ~ 25℃ 40℃ ~ 60℃ | | 8 | | 20 |
| | 26℃ OR ABOVE/ 61% OR ABOVE | | 0 | | 0 |
| MAT MEDIUM | 51% ~ 100% | -16 | 10 | -60 | 25 |
| | 20% ~ 50% | | 8 | | 20 |
| | 0% ~ 19% | | 0 | | 0 |

FIRST SCANNING

SECOND SCANNING

FIRST SCANNING + SECOND SCANNING

| | PRINTING REGION B | | PRINTING REGION C | |
|---|---|---|---|---|
| | CORRECTION VALUE FOR 288 NOZZLES (9600dpi) | | CORRECTION VALUE FOR 1280 NOZZLES (9600dpi) | |
| PRINTING MEDIUM | DEFAULT VALUE | OFFSET VALUE | DEFAULT VALUE | OFFSET VALUE |
| PHOTO GLOSSY MEDIUM | -16 | 0 | -60 | 0 |
| GLOSSY MEDIUM | -16 | 8 | -60 | 20 |
| MAT MEDIUM | -16 | 8 | -60 | 20 |

FIG.15

| PRINTING MEDIUM | TEMPERATURE -HUMIDITY REGION (℃/%) | PRINTING REGION B | | PRINTING REGION C | |
|---|---|---|---|---|---|
| | | CORRECTION VALUE FOR 288 NOZZLES (9600dpi) | | CORRECTION VALUE FOR 1280 NOZZLES (9600dpi) | |
| | | DEFAULT VALUE | OFFSET VALUE | DEFAULT VALUE | OFFSET VALUE |
| PHOTO GLOSSY MEDIUM | 14℃ OR BELOW/ 39% OR BELOW | -16 | 0 | -60 | 0 |
| | 15℃ ~ 25℃ 40℃ ~ 60℃ | | 0 | | 0 |
| | 26℃ OR ABOVE/ 61% OR ABOVE | | 0 | | 0 |
| GLOSSY MEDIUM | 14℃ OR BELOW/ 39% OR BELOW | -16 | 10 | -60 | 25 |
| | 15℃ ~ 25℃ 40℃ ~ 60℃ | | 8 | | 20 |
| | 26℃ OR ABOVE/ 61% OR ABOVE | | 6 | | 15 |
| MAT MEDIUM | 14℃ OR BELOW/ 39% OR BELOW | -16 | 10 | -60 | 25 |
| | 15℃ ~ 25℃ 40℃ ~ 60℃ | | 8 | | 20 |
| | 26℃ OR ABOVE/ 61% OR ABOVE | | 6 | | 15 |

FIG.16

| PRINTING MEDIUM | AMOUNT OF INKS APPLIED TO REAR END REGION | PRINTING REGION B | | PRINTING REGION C | |
|---|---|---|---|---|---|
| | | CORRECTION VALUE FOR 288 NOZZLES (9600dpi) | | CORRECTION VALUE FOR 1280 NOZZLES (9600dpi) | |
| | | DEFAULT VALUE | OFFSET VALUE | DEFAULT VALUE | OFFSET VALUE |
| PHOTO GLOSSY MEDIUM | 51% ~ 100% | -16 | 0 | -60 | 0 |
| | 20% ~ 50% | | 0 | | 0 |
| | 0% ~ 19% | | 0 | | 0 |
| GLOSSY MEDIUM | 51% ~ 100% | -16 | 10 | -60 | 25 |
| | 20% ~ 50% | | 8 | | 20 |
| | 0% ~ 19% | | 0 | | 0 |
| MAT MEDIUM | 51% ~ 100% | -16 | 10 | -60 | 25 |
| | 20% ~ 50% | | 8 | | 20 |
| | 0% ~ 19% | | 0 | | 0 |

FIG.17

INKJET PRINTING APPARATUS AND CONTROL METHOD FOR THE APPARATUS

BACKGROUND OF THE INVENTION

1. Field of the Invention

The present invention relates to: an inkjet printing apparatus including printing-medium conveying units arranged upstream and downstream of a printing unit which performs printing on a printing medium; and a control method for the apparatus. Specifically, the present invention relates to a technology to prevent deterioration in a printing quality due to a conveying error of a printing medium after the printing medium is released from the conveying unit arranged upstream of the printing unit.

2. Description of the Related Art

A printing apparatus generally includes a conveying unit which conveys a printing medium along a predetermined conveying path, and a printing unit which performs printing on the conveyed printing medium. Moreover, another printing apparatus may include conveying units both upstream and downstream, in a printing-medium conveying direction, of a position where a printing unit performs printing (printing position). Hereinafter, the conveying units are referred to as an upstream conveying unit and a downstream conveying unit. These upstream and downstream conveying units are involved in a printing-medium conveying operation including the supplying of a printing medium to the printing position and the discharging of the printing medium from the printing position. Generally, the upstream and downstream conveying units include a conveying roller and a discharge roller, respectively.

The conveying roller is configured of a metallic roller processed to have fine asperities on the surface thereof, and thereby to generate a large friction. Meanwhile, the discharge roller is configured of a roller made of a material having a large friction coefficient such as a rubber. Each of the conveying roller and the discharge roller is provided with a pinch roller for nipping a printing medium. The pinch roller is resiliently biased by a pressing member such as a spring. Stated differently, the upstream conveying unit is formed of the pair of the conveying roller and the corresponding pinch roller. The downstream conveying unit is formed of the pair of the discharge roller and the corresponding pinch roller.

The roller diameters and the driving systems of the conveying and discharge rollers are set so that the discharge roller can have a peripheral velocity higher than the conveying roller by approximately 0.3% to 1%. Meanwhile, the nipping force by the roller pair in the downstream conveying unit is set to be smaller than that in the upstream conveying unit. Under these settings, both of the conveying units nip and convey a printing medium without slackening thereof, so that the surface of the printing medium to be printed is kept flat. In addition, the printing medium is allowed to slip on the downstream conveying unit. Accordingly, no inappropriate load is generated. This mechanism is effective when being used for a printing unit which performs a non-contact printing on a printing medium, and particularly for an inkjet printing head (hereinafter, also simply referred to as a printing head) which performs printing by ejecting a liquid ink on a printing medium. This is because, when such a printing head is used, the distance between the ejection surface (the surface of the printing head, on which ejection outlets are provided) and the printing surface of a printing medium is strongly desired to be maintained constant in order to maintain the printing quality, and to prevent the ejection surface and the printing medium from coming into contact with each other.

Printing progresses on a printing medium in a state where the printing medium is nipped by both of the upstream and downstream conveying units (first conveying state), and then is about to reach the rear end of the printing medium. At this time, the rear end of the printing medium comes off from the position nipped by the upstream conveying unit. Thus, the printing medium is switched to a state of being nipped only by the downstream conveying unit (second conveying state). Since the downstream conveying unit conveys the printing medium at a relatively high speed, the printing medium is conveyed at the speed higher than that in the first conveying state. As a result, an excessive conveying may occur, causing the deterioration in the image quality on the printing medium such as a white stripe and color drift.

In order to solve this problem, known is a method in which a conveyance amount of the printing medium is corrected before and after the rear end of the printing medium is passed through the upstream conveying unit (for example, Japanese Patent Laid-open No. 8-282027 (1996)).

However, even when the conveyance amount in a printing apparatus with an inkjet printing head is corrected by using the method disclosed in Japanese Patent Laid-open No. 8-282027 (1996), the deterioration in the image quality such as the occurrence of a stripe on the printed image is not always suppressed. To be more specific, the present inventors have discovered that such a uniform correction is not sufficient to suppress the deterioration in the image quality, because the printing media are expanded or contracted by different amounts from each other during printing. In particular, the present inventors have discovered that use of a printing medium subjected to swelling by the application of liquid leads to the significant deterioration in the image quality due to an error in conveying the printing medium to a printing position, especially when a large amount of ink is applied to the printing medium. In addition, one of the factors causing the conveying error is, for example, that different types of the printing media are expanded or contracted by different amounts. The details of this discovery will be described as follows.

In the first conveying state, since the downstream conveying unit allows the printing medium to slip, the conveying speed or conveying distance is determined by the upstream conveying unit. Moreover, ink is not actually applied to a portion of the printing medium between the upstream conveying unit and the printing position. Thus, the printing medium is hardly influenced by the expansion or contraction of itself, and the error in the conveyance amount due to the difference in the expansion/contraction amount is not likely to occur. In contrast, in the second conveying state, ink may be applied to a portion of the printing medium between the printing position and the downstream conveying unit. In this case, a difference in the ink absorbing property and other properties of the printing media leads to variations in the expansion/contraction amount among the printing media. For this reason, even when the conveyance amount is uniformly corrected, the error in the conveyance amount to the printing position is still large, and thereby a stripe occurs in the printed image.

SUMMARY OF THE INVENTION

The present invention has been made taking the above-described problems into consideration. An object of the present invention is to stably obtain a preferable image by correcting a conveyance amount of a printing medium before and after the rear end of the printing medium passes through an upstream conveying unit, and also correcting an error due to an expansion/contraction amount of the printing medium as well.

An aspect of the present invention, there is provided an inkjet printing apparatus, which is capable of conveying a plurality of types of printing media along a conveying path, and which performs printing on the printing medium with a printing head at a printing position set on the conveying path, the inkjet printing apparatus comprising:

an upstream conveying unit arranged upstream of the printing position to convey the printing medium;

a downstream conveying unit arranged downstream of the printing position to convey the printing medium;

a correction section which corrects a conveyance amount of the printing medium when and/or after a first conveying state is switched to a second conveying state, the first conveying state being where the printing medium is conveyed by the upstream conveying unit and the downstream conveying unit, and the second conveying state being where the printing medium released from the upstream conveying unit is conveyed by only the downstream conveying unit; and an adjustment section which adjusts the corrected value of the conveyance amount used by the correction section by using an adjustment value which is set based on an expansion/contraction amount in accordance with a type of the printing medium during printing.

Another aspect of the present invention, there is provided a control method for an inkjet printing apparatus, which is capable of conveying a plurality of types of printing media along a conveying path, and which performs printing on the printing medium with a printing head at a printing position set on the conveying path, and which includes: an upstream conveying unit arranged upstream of the printing position to convey the printing medium; a downstream conveying unit arranged downstream of the printing position to convey the printing medium; the control method comprising the steps of:

correcting a conveyance amount of the printing medium when and/or after a first conveying state is switched to a second conveying state, the first conveying state being where the printing medium is conveyed by the upstream conveying unit and the downstream conveying unit, and the second conveying state being where the printing medium released from the upstream conveying unit is conveyed by only the downstream conveying unit; and adjusting the corrected value of the conveyance amount used in the correction step by using an adjustment value which is set based on an expansion/contraction amount in accordance with a type of the printing medium during printing.

According to the present invention, when the correction is performed on the conveyance amount when the printing medium is released from the upstream conveying unit and on the conveyance amount when the printing medium is conveyed by only the downstream conveying unit, the error due to the expansion/contraction amount of the printing medium itself is also corrected. Thus, the printing medium is conveyed with a high accuracy, and thereby the deterioration in the image quality is suppressed.

Further features of the present invention will become apparent from the following description of exemplary embodiments (with reference to the attached drawings).

BRIEF DESCRIPTION OF THE DRAWINGS

FIG. 15 is an explanatory view showing a table for parameters of the conveyance-amount correction according to the first embodiment;

FIG. 16 is an explanatory view showing a table for parameters of a conveyance-amount correction depending on environmental conditions according to another embodiment of the present invention; and FIG. 17 is an explanatory view showing a table for parameters of a conveyance-amount correction depending on the amount of inks to be applied according to still another embodiment of the present invention.

DESCRIPTION OF THE EMBODIMENTS

Hereinafter, the present invention will be described in detail with reference to the drawings.

Figure 1:
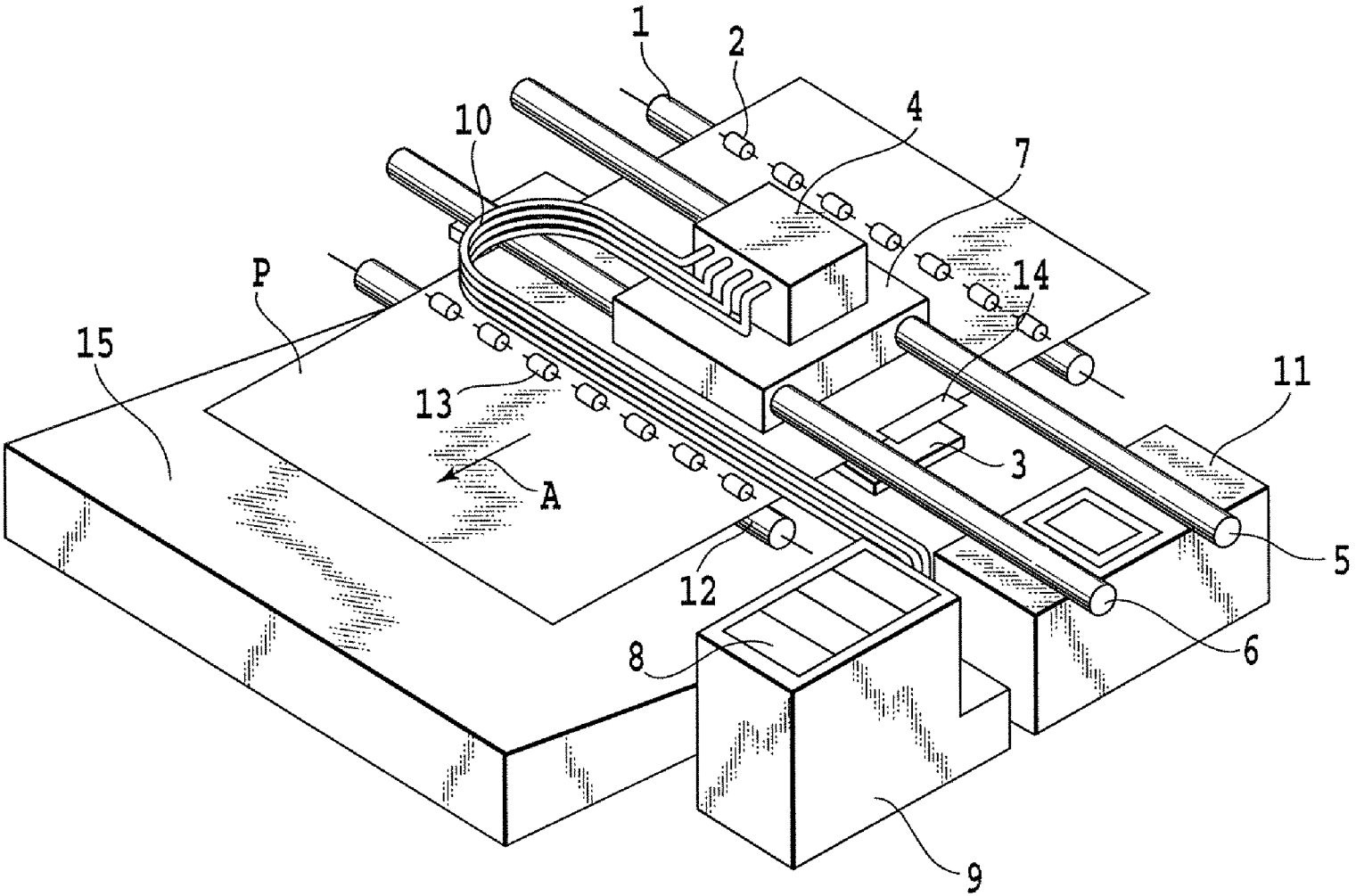
FIG. 1 is a perspective view showing the entire configuration of an inkjet printing apparatus according to a first embodiment of the present invention.

FIG. 1 is a perspective view showing the entire configuration of an inkjet printing apparatus according to an embodiment of the present invention. In printing, while being nipped between a conveying roller 1 and a pinch roller 2, a printing medium P is guided onto a platen 3 in accordance with the rotation of the conveying roller 1. Then, the printing medium P is conveyed in the direction of arrow A in FIG. 1, while being supported by the platen 3. The conveying roller 1 is arranged on a conveying path, and is a metallic roller processed to have fine asperities on the surface thereof to generate a large friction. The pinch roller 2 is resiliently biased toward the conveying roller 1 by an unillustrated pressing member such as a spring. The pinch roller 2 is driven by the conveying roller 1. These conveying roller 1 and pinch roller 2 constitute an upstream conveying unit.

The platen 3 is provided at a printing position which faces an ejection surface of a printing head 4 of an inkjet-head type. By supporting the back surface of the printing medium P, the platen 3 maintains the distance between the front surface of the printing medium P and the ejection surface to be a constant or predetermined distance.

After the printing medium P is conveyed onto the platen 3, printing is performed on the printing medium P. Subsequently, the printing medium P is conveyed in the A direction, while being nipped between a rotating discharge roller 12 and a spur 13. The spur 13 is a rotational body, and is driven by the discharge roller 12. Thereafter, the printing medium P is discharged onto an output tray 15 from the platen 3. These discharge roller 12 and spur 13 constitute a downstream conveying unit. The discharge roller 12 is a rubber roller having a large friction coefficient. The spur 13 is resiliently biased toward the discharge roller 12 by an unillustrated pressing member such as a spring. The pressure of the spur 13 toward the discharge roller 12 is set approximately 1/10 of that toward the conveying roller 1 applied from the pinch roller 2. Thereby, the surface of the printing medium P after printing an image is prevented from a scratch or dent. Moreover, in order to prevent a slack on the printing medium P, the roller diameter and the like of the conveying roller 1 are set to have a peripheral velocity higher than the discharge roller 12 by approximately 1%. Accordingly, in a state where the printing medium P is conveyed while being nipped with both the conveying roller 1 and the discharge roller 12 (first conveying state), the printing medium P is conveyed while slipping on the discharge roller 12 owing to the difference between the nipping force at the conveying roller 1 and the nipping force at the discharge roller 12.

A printing-medium holder 14 is provided on the platen 3 in order to restrict an edge of the printing medium P from rising upward. Specifically, the edge, in the direction perpendicular to the conveying direction A, of the printing medium P is restricted from curling in the direction of the ejection surface of the printing head 4. The printing head 4 is detachably mounted on a carriage 7 with the ejection surface facing the platen 3 or the printing medium P. The carriage 7 is reciprocally moved along two guide rails 5, 6 by an unillustrated driving unit such as a motor. During this movement, the printing head 4 is allowed to eject ink. The moving direction of the carriage 4 is perpendicular to the printing-medium conveying direction (the direction of the arrow A), and called a main scanning direction. Meanwhile, the printing-medium conveying direction is called a sub scanning direction. By alternately repeating the main scanning by the carriage 7 or the printing head 4 and the conveying (the sub scanning) of the printing medium P, the printing is performed on the printing medium P.

Here, as the printing head 4, it is possible to use a type of printing head provided with an element which generates a thermal energy as an energy for ink ejection (for example, a heat-generating resistive element). The heat energy causes the state of ink to change (film boiling). Thereby, a high-density and high-precision printing is achieved. However, the type of printing head is not limited to this. Other types of printing heads which utilize a vibrating energy or other energies may be used. Moreover, as the printing head 4, it is possible to use a printing head provided with a plurality of nozzle arrays each of which ejects a different color ink from those of the others. Each of the nozzle arrays may be formed of 1280 nozzles which are aligned at an interval of 1200 dpi (dots per inch).

A plurality of independent ink tanks 8 are removably mounted in a tank mounting unit 9. The number of ink tanks 8 corresponds to that of ink colors, the inks being ejected from the printing head 4. The tank mounting unit 9 and the printing head 4 are connected to each other via a plurality of liquid-supply tubes 10 corresponding to the respective ink colors. By mounting the ink tanks 8 in the tank mounting unit 9, the color inks in the ink tanks 8 are independently supplied to the respective nozzle arrays, of the printing head 4, corresponding to the color of inks.

Furthermore, a recovery unit 11 is provided in a place within a range where the printing head 4 can move in the main scanning direction and within a non-printing region outside a side edge of the printing medium P or the platen 3. The recovery unit 11 is able to face the ejection surface of the printing head 4, and is provided with a known configuration as follows: specifically, a cap portion which caps the ejection surface of the printing head 4; a sucking mechanism which forcefully sucks ink from the printing head 4 while the ejection surface is capped; a cleaning blade which wipes an unclean ink-ejection surface; and the like.

Figure 2:
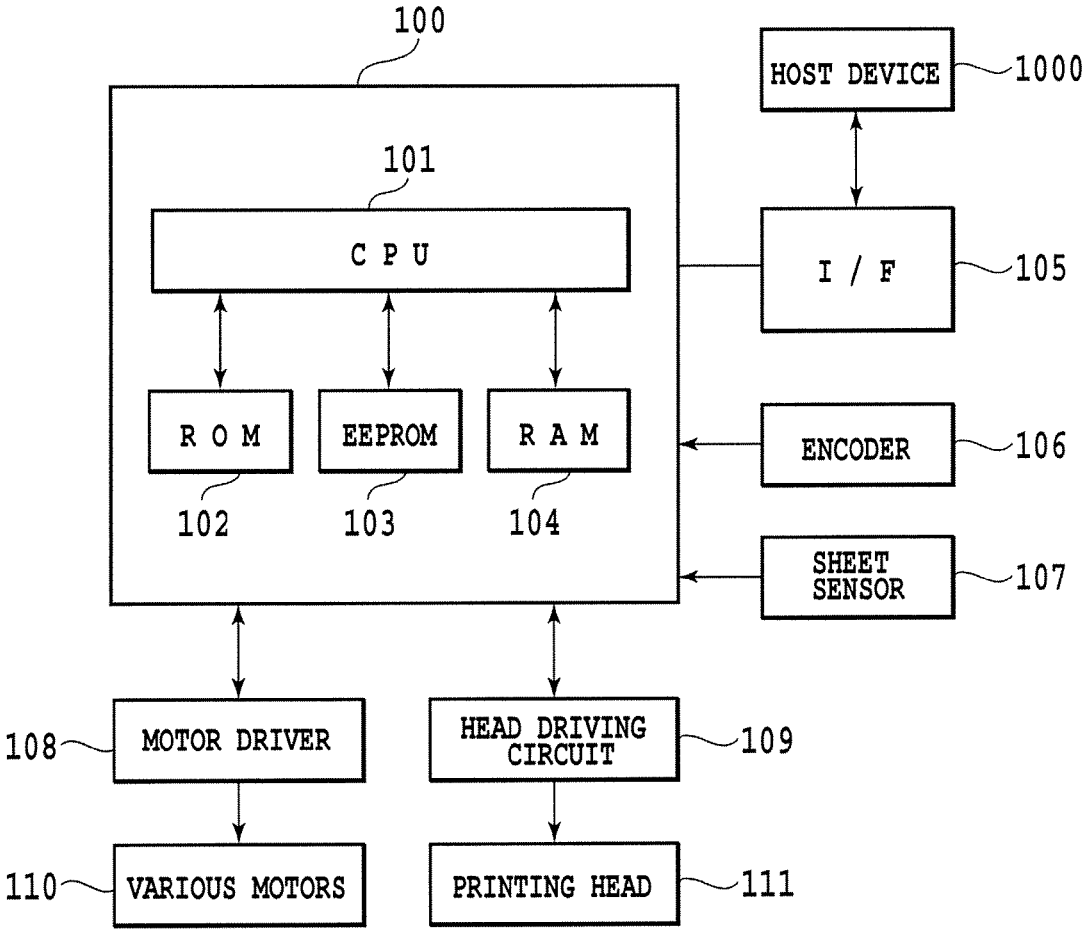
FIG. 2 is a block diagram showing a configuration example of the main part of a control system of the inkjet printing apparatus according to the embodiment in FIG. 1.

FIG. 2 shows a configuration example of the main part of a control system of the inkjet printing apparatus according to this embodiment. Here, reference numeral 100 denotes a controller which controls each driving unit of the inkjet printing apparatus according to this embodiment. The controller 100 includes a CPU 101, a ROM 102, an EEPROM 103 and a RAM 104. The CPU 101 performs various calculations and determinations for processes of a printing operation and the like including a processing procedure which will be described later. The CPU 101 also performs processes of printing data, a test pattern, and the like. The ROM 102 stores a program for the processing procedure executed by the CPU 101, other fixed data, and the like. The EEPROM 103 is a nonvolatile memory, and is used to store predetermined information even when the power of the printing apparatus is tuned turned off. Particularly, in this embodiment, the EEPROM 103 can be used to store a predetermined correction value and offset amount in terms of a conveyance amount of each printing medium, which will be described later. The RAM 104 temporarily stores image data supplied from the outside, and printing data arranged from the image data in accordance with the apparatus configuration. The RAM 104 also functions as a work area for the calculation process by the CPU 101.

An interface (I/F) 105 has a function to connect the controller 100 to an external device 1000, and performs bidirectional communications with the external device 1000 on the basis of a predetermined protocol. Note that the external device 1000 has a known form such as a computer or the like. The external device 1000 serves as a supply source of the printing data to be printed by the printing apparatus according to this embodiment. A printer driver is installed in the external device 1000, the printer driver being a program for the apparatus to perform the printing operation. In other words, the printer driver sends: the image data to be printed; setting information for the printing such as information on each type of printing medium on which the printing data is printed; and a control command to control the operations of the printing apparatus.

An encoder 106 detects a position of the printing head 4 in the main scanning direction. A sheet sensor 107 is provided at an appropriate position on the printing-medium conveying path. By detecting the front and back ends of the printing medium with this sheet sensor 107, it is possible to know the conveying (sub scanning) position of the printing medium. A motor driver 108 and a head driving circuit 109 are further connected to controller 100. Under the control of the controller 100, the motor driver 108 drives a conveying motor serving as a driving source for conveying the printing medium, a main scanning motor serving as a driving source for moving the carriage 7, and other various motors. Under the control of the controller 100, the head driving circuit 109 drives a printing head 111 to perform an ejection operation.

Next, description will be given of the more specific printing operation according to this embodiment. Note that, in this embodiment, the printing is performed so that the printing on the same area of a printing medium can be completed by main scanning at one time or plural times. Moreover, the printing operation may be changed on the basis of the combination of a type of printing medium and a printing quality. Hereinafter, description is given by citing an 8-pass printing operation in which the printing on the same area of a printing medium is completed by main scanning at eight times.

In this embodiment, the printing surface of a printing medium is divided into three regions. A conveyance amount and a printing operation in one region are different from those in the other regions.

Figure 3:
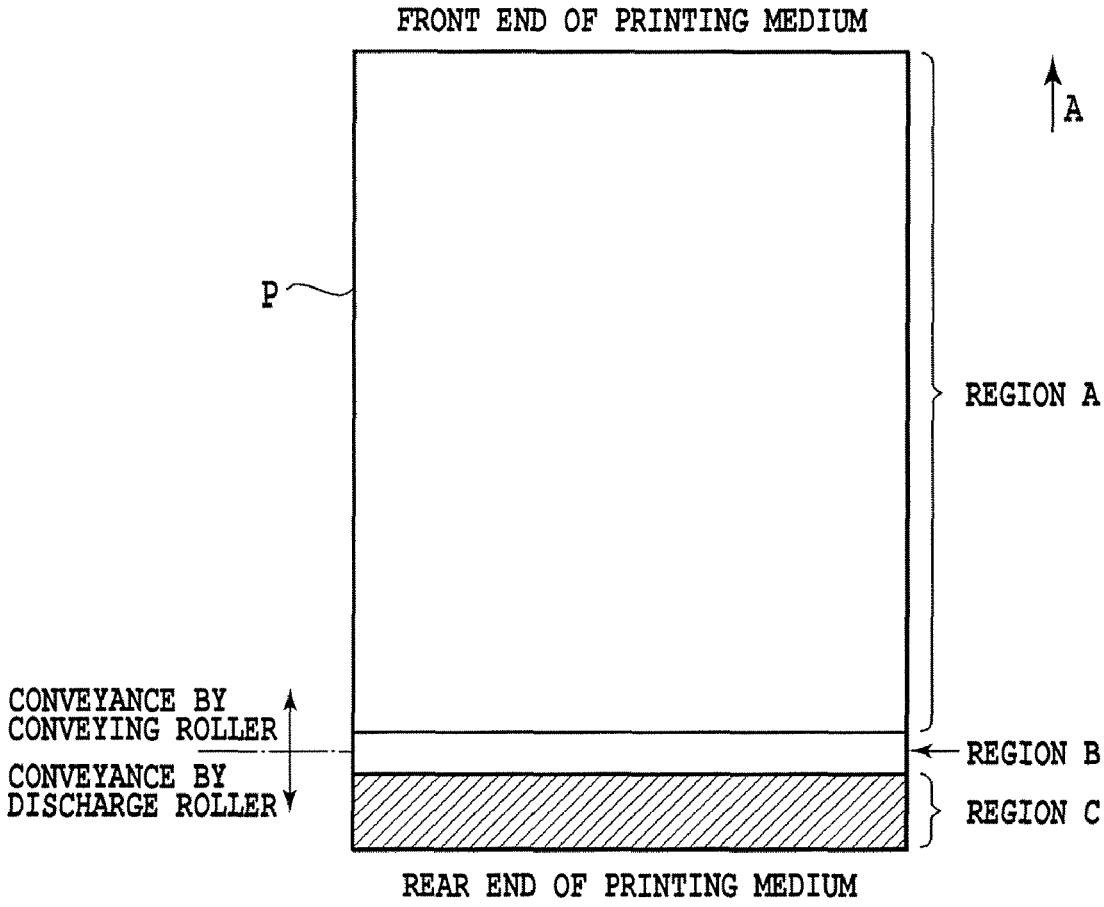
FIG. 3 is an explanatory view showing how a printed region of a printing medium is divided.
Figure 9:
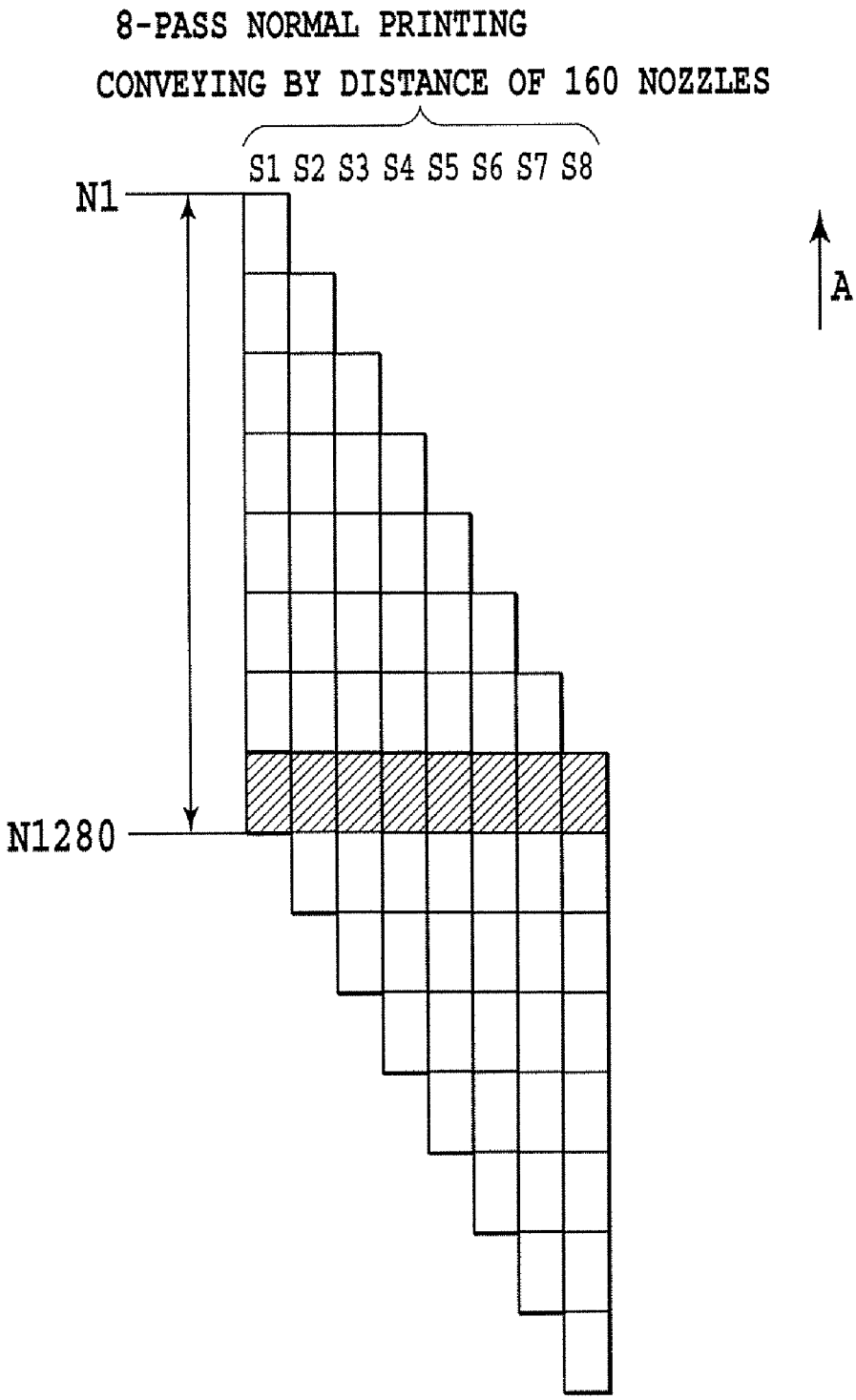
FIG. 9 is an explanatory view for a printing operation and a conveying operation on the front end to the central part of the printing medium shown in FIG. 3.
Figure 10:
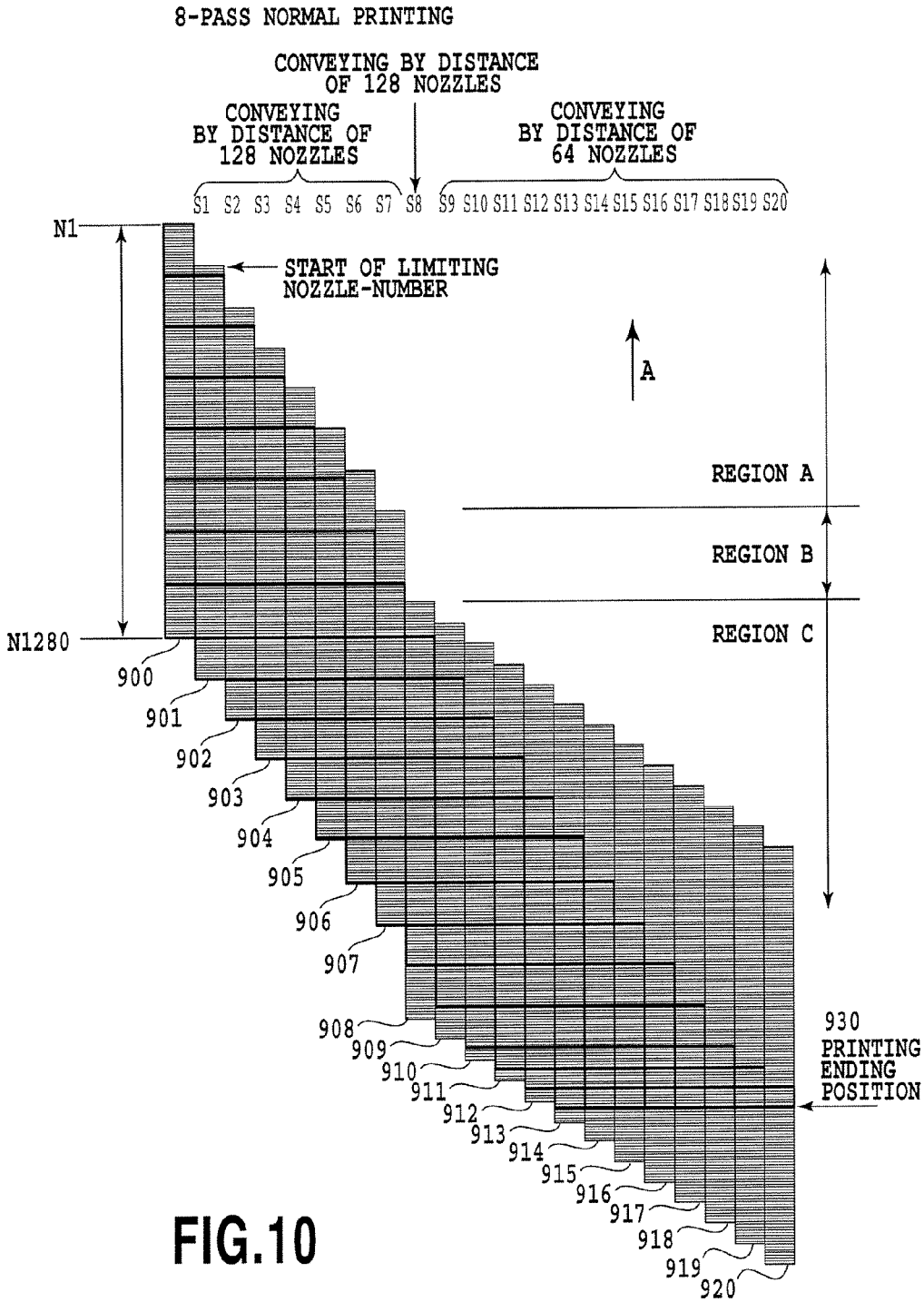
FIG. 10 is an explanatory view for a printing operation and a conveying operation on the rear end of the printing medium shown in FIG. 3.

FIG. 3 is an explanatory view showing an example where a printing medium is divided into three printed regions. FIGS. 4 to 8 are schematic side views for explaining positional relations among the printing medium, the conveying roller and the discharge roller, in a process of conveying the printing medium. FIGS. 9 and 10 are explanatory views for the printing operation and conveying operation in the 8-pass printing operation.

Figure 4:
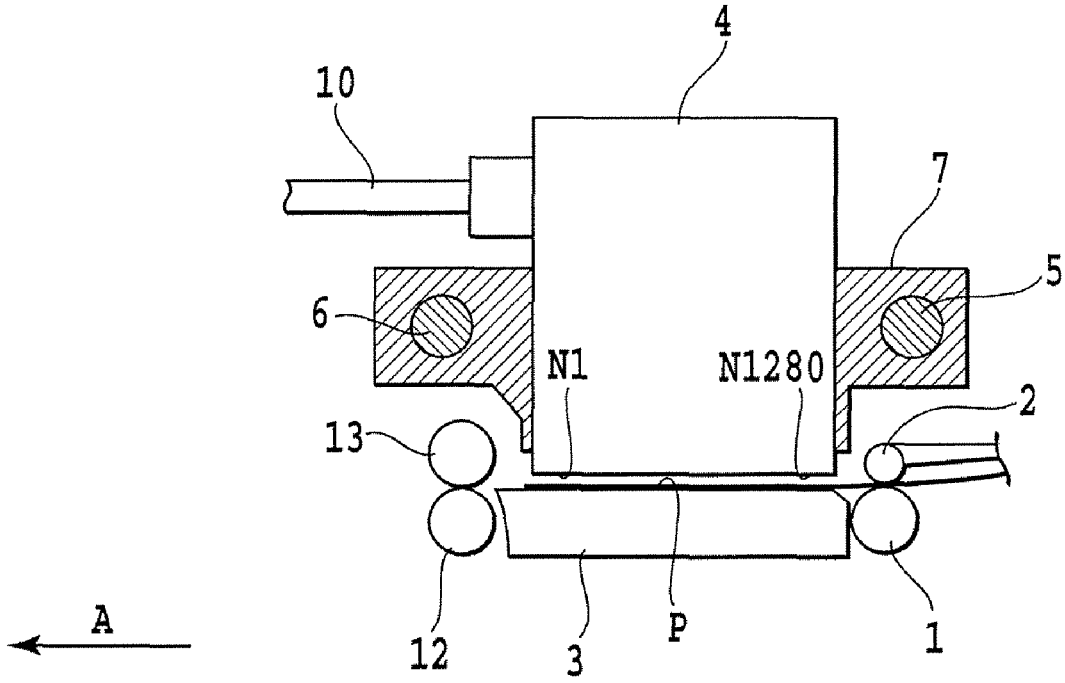
FIGS. 4 to 8 are schematic side views for explaining positional relations among the printing medium, a conveying roller and a discharge roller, in a process of conveying the printing medium.
Figure 5:
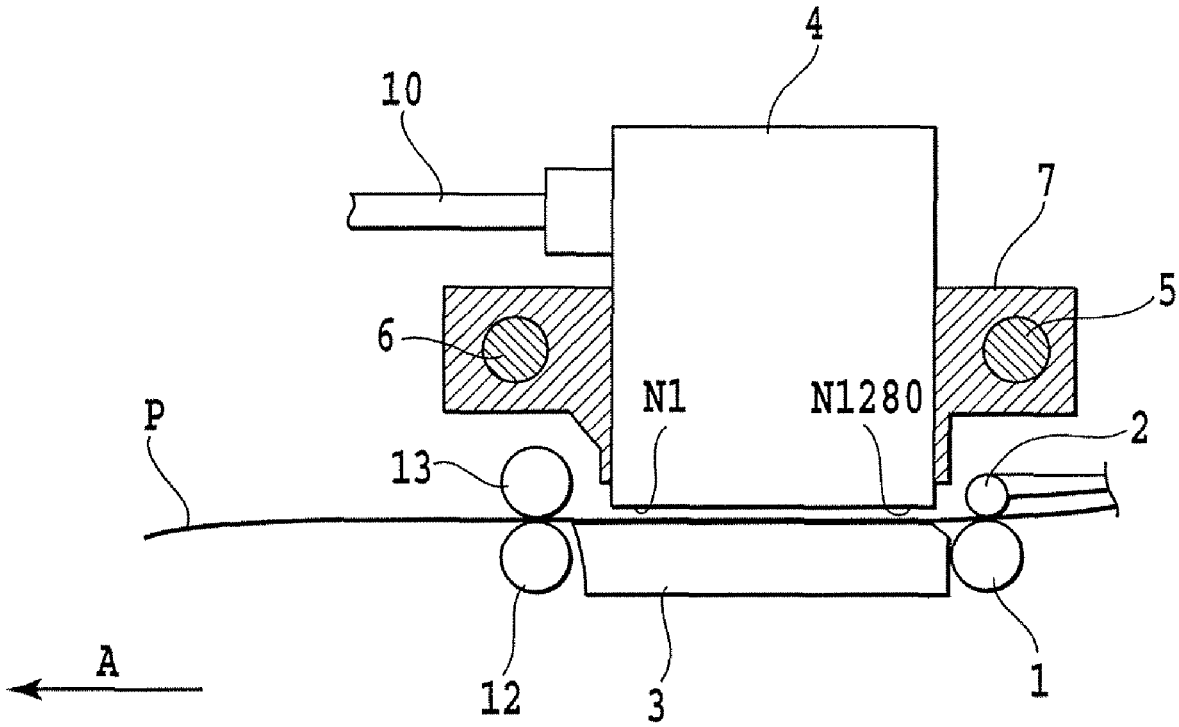

In a region A in FIG. 3, the printing medium P is conveyed by only the conveying roller 1 as shown in FIG. 4, or conveyed by the two rollers of the conveying roller 1 and the discharge roller 12 as shown in FIG. 5. This state is called the first conveying state. As described above, the nipping force by the conveying roller 1 and the pinch roller 2 is sufficiently greater than that by the discharge roller 12 and the spur 13. Accordingly, the conveyance amount in FIG. 4 is the same as that in FIG. 5.

Description will be given of the printing operation and conveying operation performed in the region A using the printing head provided with 1280 nozzles per each color. FIG. 9 is the explanatory view thereof. In FIG. 9, a single cell corresponds to the 160 continuous nozzles. N1 indicates the first nozzle which is located most downstream (discharge roller 12 side) N1280 indicates the 1280th nozzle which is located most upstream (conveying roller 1 side). Additionally, s1 to s8 indicate the sequence of the main scanning performed by the printing head 4 within the range shown in FIG. 9. Note that, in FIG. 9, although the nozzle array is drawn as if the nozzle array moved relatively to a printing position of the printing medium in the upper to lower direction in order to simplify the description of the printing operation, the printing operation is actually performed while the printing medium moves in the direction A in FIG. 9.

In the region A, the printing may be performed with all of the 1280 nozzles corresponding to each color provided to the printing head, and the printing is performed to the region immediately in front of a region B. After the printing by the first main scanning s1 is performed, the printing medium is conveyed by a distance corresponding to 160 nozzles. Then, the printing is performed by the second main scanning s2. After that, the conveying of the printing medium in the distance of 160 nozzles and the printing by the single main scanning are alternately performed thereby to complete printing an image of the same area by the eight-time main scanning. In FIG. 9, a hatch is drawn in the area (corresponds to the 160 nozzles) where the printing has been completed by the eight-time main scanning.

Figure 6:
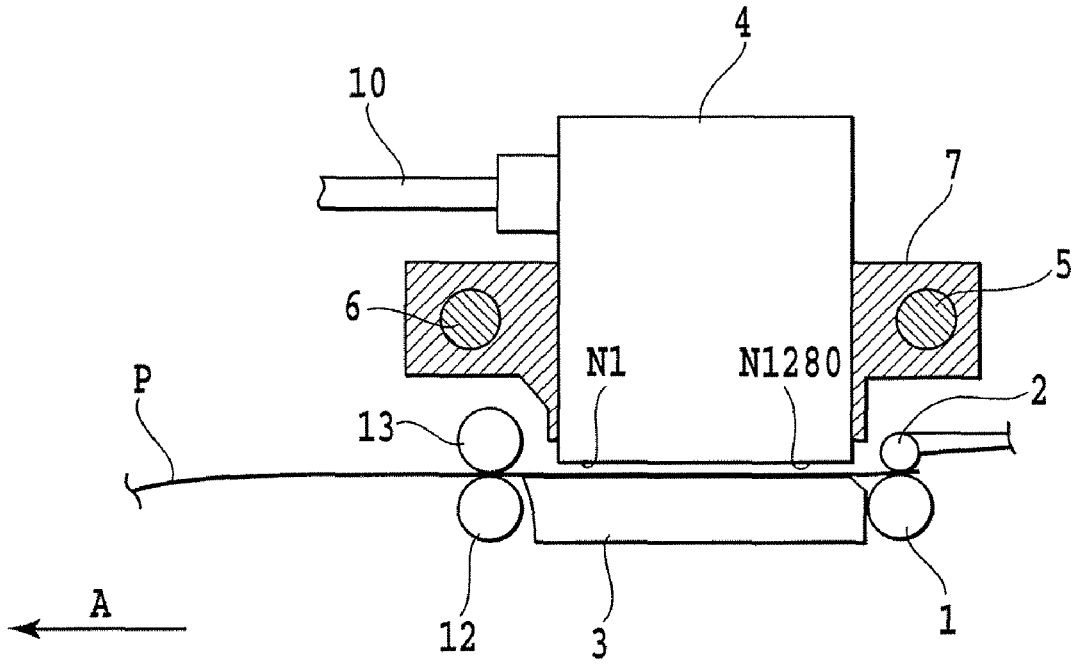
Figure 7:
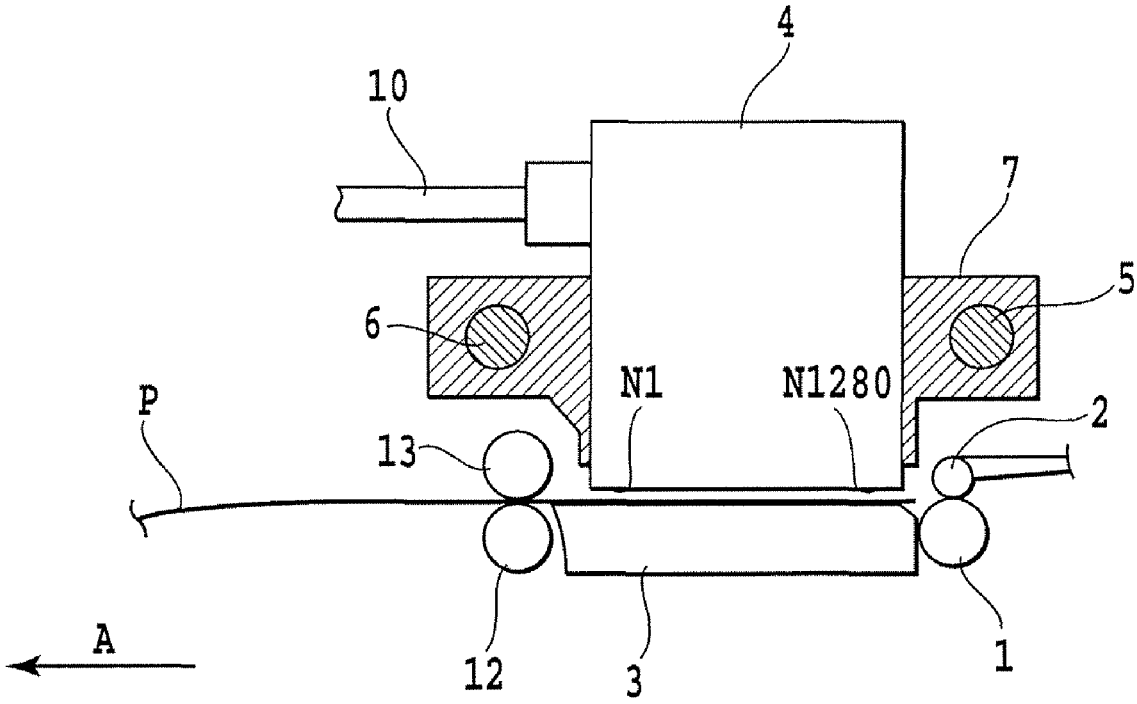

In the region B in FIG. 3, the state where the printing medium P is conveyed by the two rollers of the conveying roller 1 and the discharge roller 12 (first conveying state) as shown in FIG. 6 is switched to the state where the printing medium P is conveyed by only the discharge roller 12 (second conveying state) as shown in FIG. 7. In the region B, the rear end of the printing medium P may be pushed out at the moment when the printing medium P comes off from the conveying roller 1 and the pinch roller 2, resulting in the drift of the image. This phenomenon is called a kicking phenomenon. For this reason, the printing is performed so that the conveying cannot stop at 3 mm in front of and behind a nip position of the conveying roller 1 and the pinch roller 2. Thereby, it is not necessary to take the kicking phenomenon into consideration, and it is only necessary to perform a conveyance-amount correction surely for the conveying state where the rear end of the printing medium P comes off from the conveying roller 1. The range of the 3 mm in front of and behind the nip position of the conveying roller 1 and the pinch roller 2 can be altered on the basis of a conveying error of the rear end of the printing medium P. In this embodiment, the range is set considering all kinds of errors.

Figure 8:
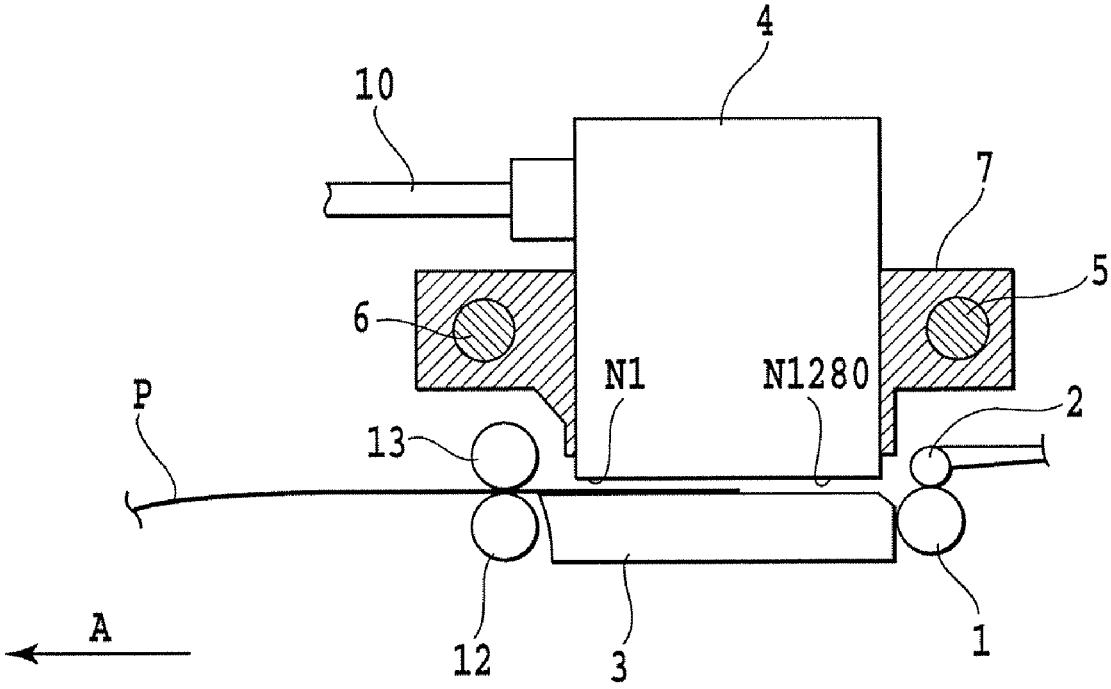

In the region C in FIG. 3, the printing medium P is conveyed by only the discharge roller 12 from the position of the printing medium P shown in FIG. 7 to the position of the printing medium P when the printing is ended as shown in FIG. 8 (the second conveying state). The conveying of the printing medium in the region C is likely to cause a slip, and thereby the image may be deteriorated. This is because the used discharge roller 12 is made of a rubber, and the conveying is easily influenced by an eccentric error of the roller. This is also because the nipping force of the discharge roller 12 with the spur 13 is small. In order to prevent this problem, the single-conveying length (the amount of the sub scanning) by the discharge roller 12 is reduced to the distance of 64 nozzles, though it corresponds to the distance of 160 nozzles in the region A.

With reference to FIG. 10, further specific description will be given of the printing operation and conveying operation when the conveying progresses from the regions A, B to further C. In the drawing, a cell surrounded by a thick solid line shows a nozzle group used for the printing, while a cell surrounded by a thin solid line shows a non-used nozzle group. In addition, s1 to s20 shows the sequence of the main scanning by the printing head 4 within the illustrated range.

A printing operation 900 is performed by the main scanning s1 before the printing on the region A is ended by the eight-time main scanning. Until the printing operation 900, all the 1280 nozzles may be used as described above (all of the cells drawn by the thick solid lines include the 160 nozzles to be used, respectively). However, the number of nozzles to be used is reduced from a printing operation 901 performed by the main scanning s2. The starting position of the printing operation 901 is determined by calculating the distance from the rear end position of the printing medium P. The number of nozzles to be used is sequentially reduced from the printing operation 901 to a printing operation 907 by the number of 32 nozzles. In synchronism with this, the conveyance amount between each main scanning from the printing operation 901 to the printing operation 907 is also reduced by the distance from 160 nozzles to 128 nozzles. The rear end position of the printing medium P when the printing operation 907 is performed is the position shown in FIG. 6, and the position is apart upstream from the nip position of the conveying roller 1 and the pinch roller 2 in the distance of 144 nozzles (3 mm).

Then, the printing is performed on the region B, and the printing medium P is conveyed to the starting position of a printing operation 908 by the distance of 288 nozzles (6 mm). As a result, the starting position of the printing operation 908 is the position shown in FIG. 7, and the position is apart downstream from the nip position of the conveying roller 1 and the pinch roller 2 in the distance of 144 nozzles (3 mm).

Subsequently, the printing and the conveying are performed on the region C. Specifically, the number of nozzles to be used is reduced after the printing by the printing operation 908 until a printing operation 920, as shown in FIG. 10. The conveying of the printing medium by the distance of 64 nozzles for each operation and the printing by the single main scanning are alternately repeated until the printing of an image at a printing ending position 930 is completed. In this embodiment, the printing ending position 930 is the position away from the rear end position of the printing medium P in the distance of 3 mm. In other words, the blank space of the rear end is 3 mm. Note that, it is needless to say that the blank space of the rear end can be set 3 mm or less, and that it is possible to perform a margin-less printing with the blank space of 0 mm by providing openings on the platen 3.

Next, description will be given of the correction of the conveyance amounts in the regions A, B and C.

The conveyance amount in the region A can be corrected in accordance with a type of the printing medium. The ROM 102 and the like store the conveying correction amount in the unit of 1/9600 inches per the conveyance amount for the 1280 nozzles. A value proportionally calculated for each conveyance amount is added to the conveyance amount in that unit. As the correction amount, an appropriate value can be set on the basis of a test pattern or the like to be described later. In the region A, the printing medium is nipped and conveyed by the respective upstream and downstream conveying units. As a result, the conveyance amount in the region A does not comparatively differ from those of cases where ink is applied to the printing medium which is likely to swell, and where ink is hardly applied. Thus, when the correction result based on the test pattern is used, a preferable image is obtained.

On the other hand, in the regions B and C, the conveying error with respect to the printing position occurs due to the difference in the expansion/contraction amount of the printing medium itself by the application of ink. For this reason, in this embodiment, offsetting is performed on the correction value obtained by adding the expansion/contraction amount when the printing medium is provided with ink to the correction result based on the test pattern. Hereinbelow, specific description will be given of the correction of the conveyance amounts in the regions B and C.

Figure 11:
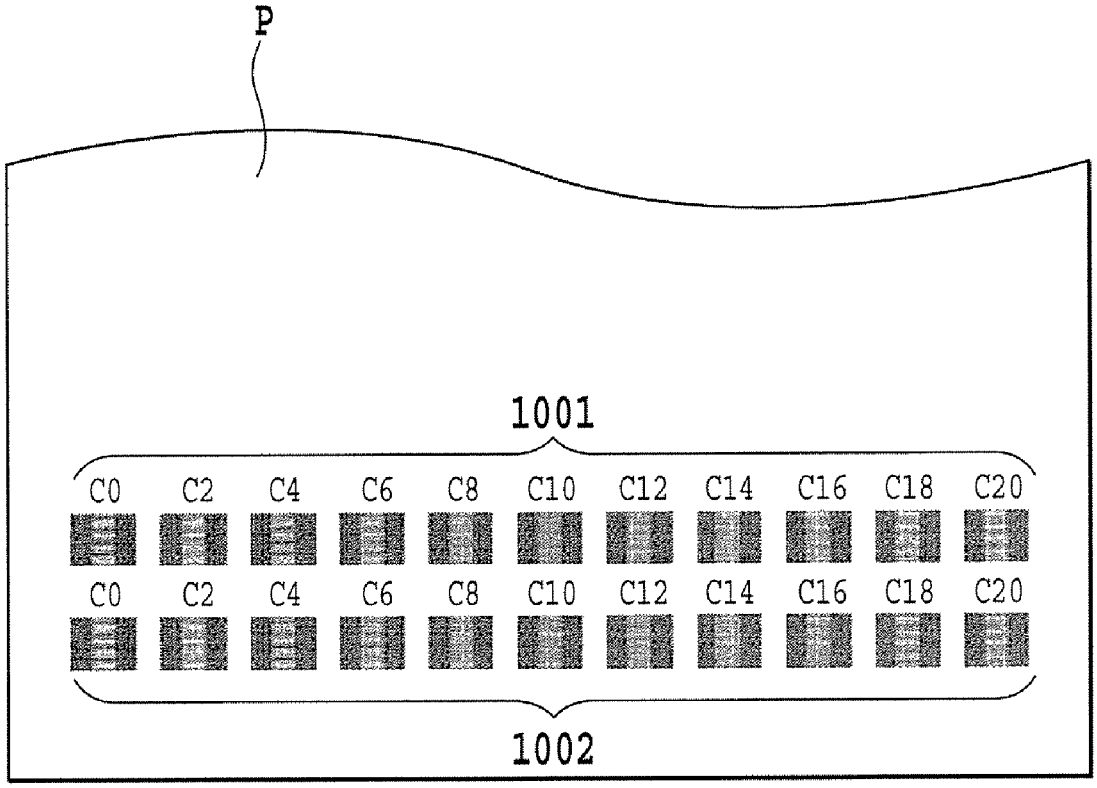
FIG. 11 is a drawing showing an example of a test pattern for setting a conveyance-amount correction value for the rear end of the printing medium shown in FIG. 3.
Figure 12A:
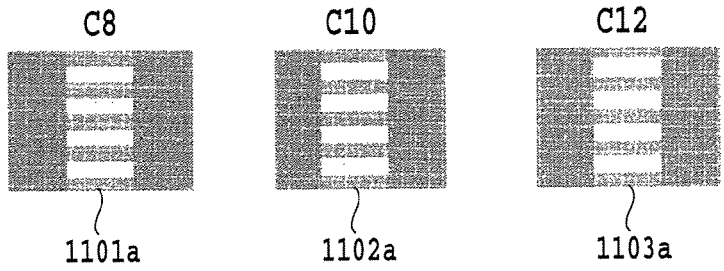
FIGS. 12A to 12C are explanatory views for a method of forming a patch of the test pattern in FIG. 11.
Figure 12B:
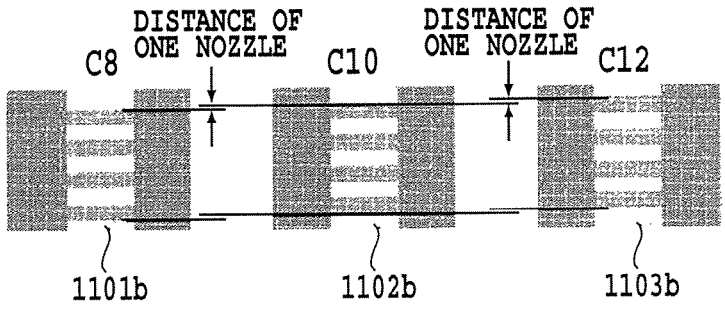
Figure 12C:
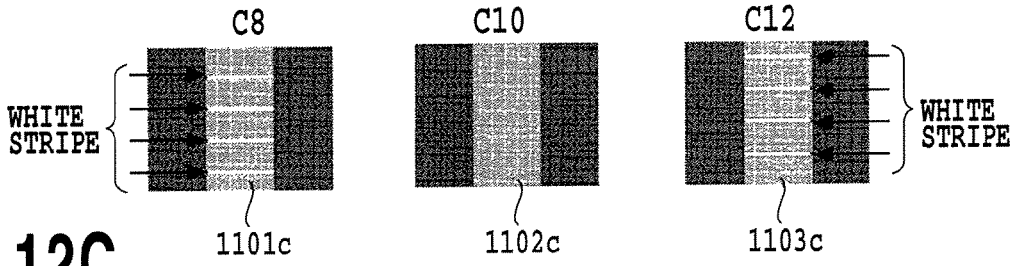
Figure 13:
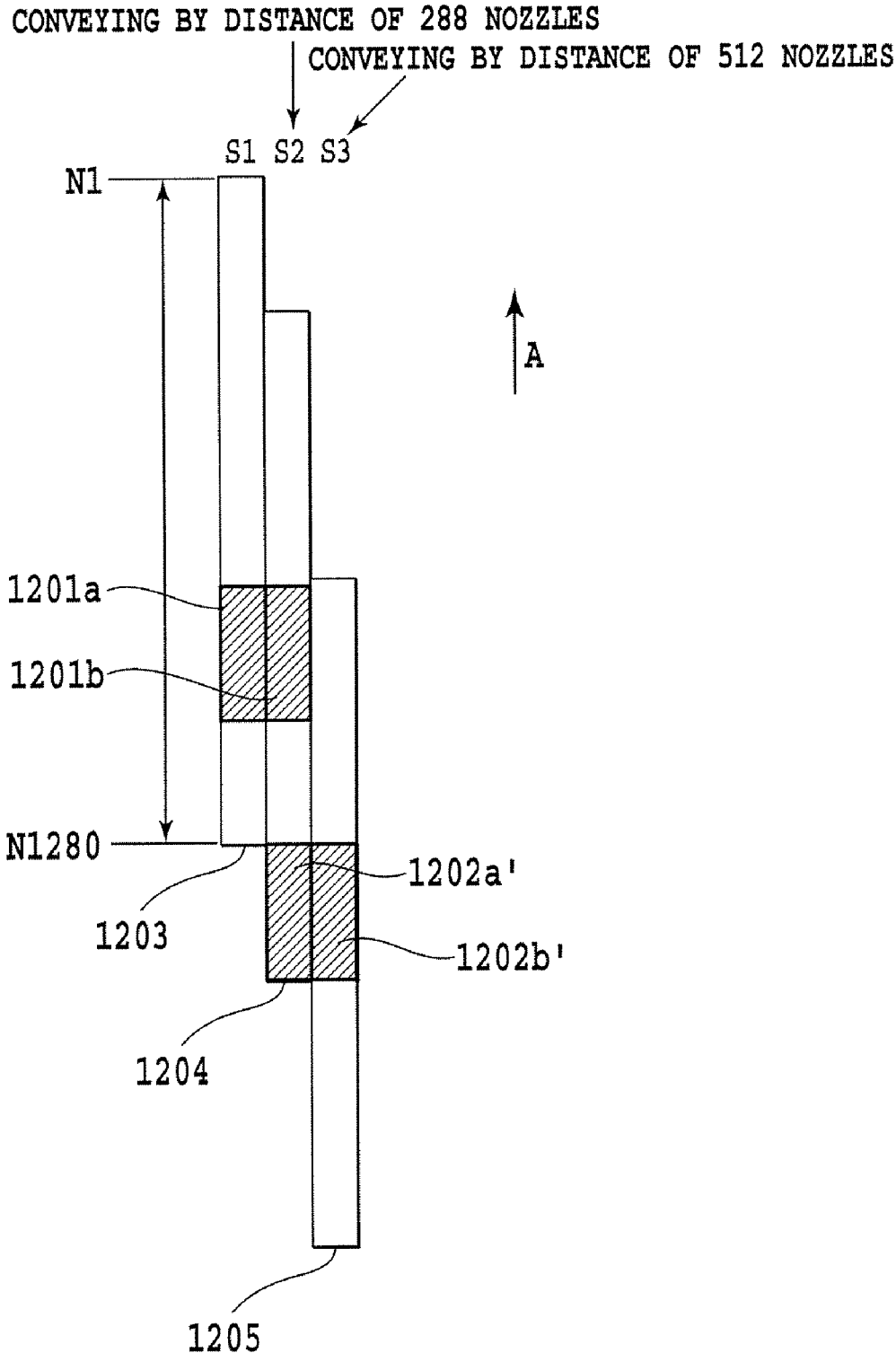
FIG. 13 is an explanatory view for a printing operation and a conveying operation when the test pattern is formed.

FIG. 11 is a drawing showing an example of the test pattern for setting conveyance-amount correction values for the regions B and C. FIGS. 12A to 12C are explanatory views for a method of forming a patch of the test pattern in FIG. 11. FIG. 13 is an explanatory view for a printing operation and a conveying operation when the test pattern is formed.

In FIG. 11, reference numeral 1001 denotes a pattern array with which the correction value for the region B can be set, and reference numeral 1002 denotes a pattern array with which the correction value for the region C can be set. These pattern arrays are printed at the position, away predetermined distance from the rear end position of the printing medium P, used for the formation of the test pattern. That is, the pattern arrays are printed in the regions B and C, respectively. To each of the patches in the pattern arrays 1001 and 1002, assigned are reference symbols whose number part is written by every two numbers from C0 to C20. The pattern arrays 1001 and 1002 have the same image patterns, and are formed by the two-time main scanning printing.

FIG. 12A shows printed images of the three adjacent patches in the center of the pattern array 1001 or 1002, the images being printed by the first main scanning. Here, the images in the pattern array 1001 are printed by the first main scanning s1 with a nozzle group 1201*a* shown in FIG. 13. The images in the pattern array 1002 are printed by the second main scanning s2 with a nozzle group 1202*a*' shown in FIG. 13. FIG. 12B shows printed images of the three adjacent patches in the center of the pattern array 1001 or 1002, the images being printed by the second main scanning. Here, the images in the pattern array 1001 are printed by the second main scanning s2 with a nozzle group 1201*b* shown in FIG. 13. The patches in the pattern array 1002 are printed by the third main scanning s3 with a nozzle group 1202*b*' shown in FIG. 13.

In this respect, the horizontal stripe pattern at the center of the patch 1102*a* (FIG. 12A) is arranged with dots so that a uniform halftone image, such as a patch 1102*c* (FIG. 12C), can be obtained by overlapping the patch 1102*a* with a patch 1102*b* (FIG. 12B) at the same position. Although a patch 1101*a* and a patch 1103*a* have the same patterns, the horizontal stripe pattern at the center of a patch 1101*b* is shifted downward by the distance of one dot in the density of 1200 dpi. Meanwhile, the pattern of a patch 1103*b* is shifted upward in the distance of one dot in the same density. Thus, when the patch 1101*a* and the patch 1101*b* are overlapped with each other at the same position, white stripes occur in a halftone image as shown in a patch 1101*c*. Likewise, when the patch 1103*a* and the patch 1103*b* are overlapped with each other at the same position, white stripes occur in a halftone image as shown in a patch 1103*c*.

The patch 1102*c* shown in FIG. 12C is formed when a printing medium is conveyed without error from the position where the patch 1102*a* is formed to the position where the patch 1102*b* is formed. Thus, when the conveyance amount is larger by the amount of, for example, one nozzle (that is, 1/1200 inches), the patch 1103*c* is formed to be a uniform halftone image. In contrast, when the conveyance amount is smaller by the amount of 1/1200 inches, the patch 1101*c* is formed to be a uniform halftone image.

Next, description will be given of the printing operation and conveying operation when the pattern arrays 1001 and 1002 are formed. When a printing operation 1203 is performed with the nozzle group 1201*a* shown in FIG. 13, the rear end position of the printing medium P is the position shown in FIG. 6, and the position is apart upstream from the nip position of the conveying roller 1 and the pinch roller 2 by the distance of 144 nozzles (approximately 3 mm).

Then, the printing medium P is conveyed by the distance of 288 nozzles (approximately 6 mm). Accordingly, the starting position of a printing operation 1204 performed with the nozzle groups 1201*b* and 1202*a*' is the position shown in FIG. 7. This position is apart downstream from the nip position of the conveying roller 1 and the pinch roller 2 in the distance of 144 nozzles (3 mm). Thereby, the pattern array 1001 is completed, and simultaneously, the first-main-scanning printing is performed on the pattern array 1002. The conveyance amount in forming the pattern array 1001 in the test pattern is the same as that in forming a real image.

Subsequently, the printing medium P is conveyed by the distance of 512 nozzles (approximately 10.8 mm), and a printing operation 1205 is performed by the nozzle group 1202*b*'. Thereby, the pattern array 1002 is completed. As described above, the pattern array 1001 is formed by conveying the printing medium P in the distance of 288 nozzles (approximately 6 mm) which is the same as that in the region B. The pattern array 1002 is formed by conveying the printing medium P in the distance of 512 nozzles (approximately 10.8 mm) which is the same as that in the region C.

With referring back to FIG. 11, the 11 patches are respectively aligned in the pattern arrays 1001 and 1002 in the main scanning direction. The patches are arranged with dots, so that the patterns of the respective patches are sequentially shifted by the distance of one dot in the density of 1200 dpi with respect to the central patch. Eventually, the patterns of the respective patches are shifted by the distances of 1 dot to 5 dots in both of the pattern arrays 1001 and 1002. In other words, it is possible to recognize a conveying error in the distance of ±5 dots (in the unit of 1200 dpi) in the regions B and C. Incidentally, although the numbers for denoting the patches shown in FIG. 11 are only the even numbers, odd numbers between the even numbers can be selected (for example, C11 between C10 and C12) when the adjacent patches are like uniform halftone images. Thereby, it is possible to recognize a conveying error in the distance of up to 0.5 dots in the unit of 9600 dpi.

Next, the description will be given of processes of the formation of a test pattern and the setting of a correction value based on the test pattern.

Figure 14A:
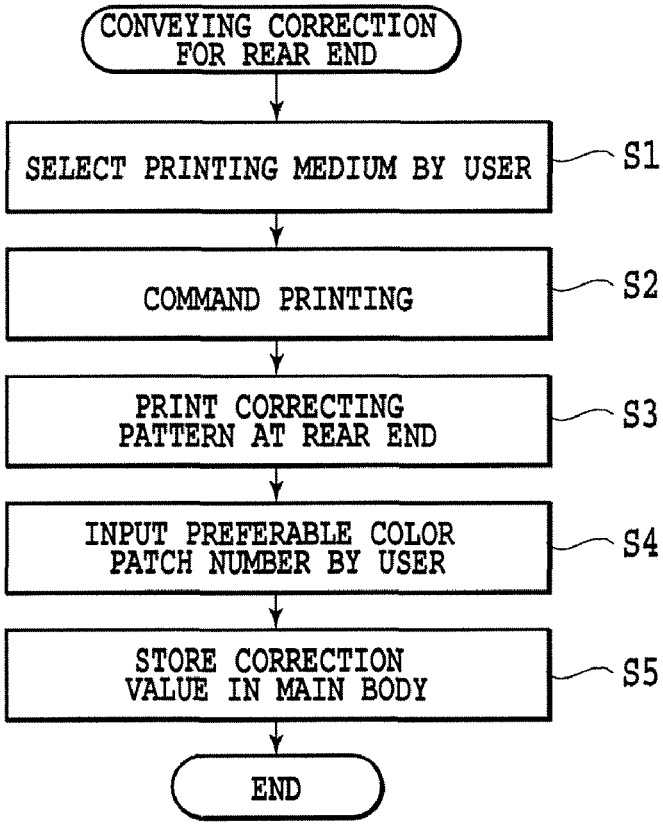
FIG. 14A is a flowchart illustrating an example of a process procedure for the formation of the test pattern according to the first embodiment, and for setting a correction value based on the test pattern.
Figure 14B:
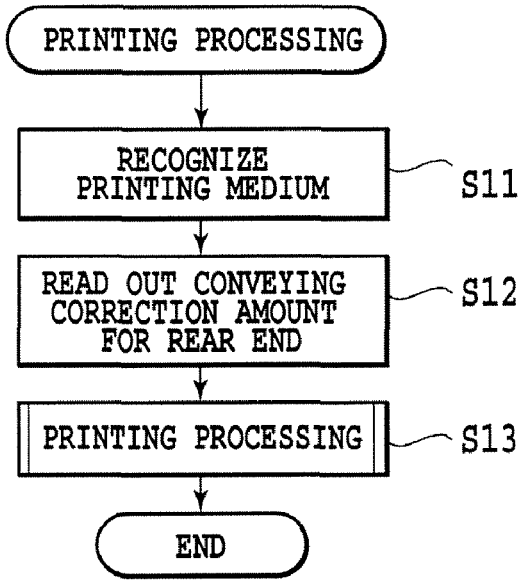
FIG. 14B is a flowchart illustrating an example of a printing-process procedure with the correction value thus set for the conveyance amount.

FIG. 14A is a flowchart illustrating an example of the processing procedure. FIG. 14B is a flowchart illustrating an example of a printing-process procedure with the correction value thus set for the conveyance amount. FIG. 15 shows a table illustrating an example of parameters of the conveyance-amount correction. Note that all of the conveying correction amounts may be stored in the unit of 9600 dpi as described above.

In Step S1 shown in FIG. 14A, firstly, the user sets a printing medium to be adjusted in the regions B and C, and inputs the information on the type of printing medium. Then, in Step S2, the user instructs the printing to be started. Thereby, the test pattern shown in FIG. 11 is printed in Step S3. The user visually observes the printing result, and inputs the number of the most preferable patch (in which a uniform halftone with the least amount of white stripes is reproduced) in Step S4. In Step S5, the already-stored correction value is rewritten on the basis of the inputted value, and then the correction value is updated and stored.

With this correction value thus stored, the printing process as shown in FIG. 14B can be performed. Specifically, when the printing process is started, the type of the printing medium thus set is recognized (Step S11). Then, the correction value for the conveyance amounts of the rear end of the printing medium (in the regions B and C) is read out in accordance with the type of the printing medium (Step S12). This correction value is either the default value or the above-described updated and stored value. Thus, the printing process is performed. Note that, at this time, a conveyance amount based on the correction value thus read out in Step S12 and an offset amount thereof are set for the rear end of the printing medium.

In the example in FIG. 15, shown are three types of printing medium: a "photo glossy medium", a "glossy medium" and a "mat medium". As for the "photo glossy medium", the base material to be a base of the printing medium is formed of a polyethylene resin layer, and hardly expands or contracts when ink is applied thereto. In the meanwhile, as for the "glossy medium" and the "mat medium", the base materials to be bases are formed of paper, and thus expands or contracts upon the application of ink. For this reason, it is strongly desirable to adopt an offset amount to the correction value set by the test pattern when a real image is printed on the "glossy medium" and the "mat medium".

Next, description will be given of the setting for the correction value and the adaptation of the offset amount.

Firstly, description will be given of an example of the "photo glossy medium" which hardly expands or contracts. The conveying correction amount for the pattern array 1001, that is, the region B, is −16 dots (in the density of 9600 dpi) which is the default value for conveying a printing medium by the distance of 288 nozzles (in the density of 1200 dpi) of the region B. The conveyance amount is reduced in this amount, and thereby the pattern array 1001 is formed. At this time, the correction value stored when the patch C10 is selected in the test pattern remains "−16". In the meanwhile, when the patch C12 is selected, the correction is performed to increase the conveying length in the distance of 1 nozzle (in the density of 1200 dpi). In other words, the distance of 1 nozzle (in the density of 1200 dpi) equal to 8 dots (in the density of 9600 dpi) is added to the correction value, and thereby the value of "−8" is obtained. This value is newly written and stored as the correction value for the region B. The conveying length in a real printing operation is the distance obtained by subtracting 8 dots (in the density of 9600 dpi) from the conveying length of 288 nozzles (in the density of 1200 dpi) of the region B.

The conveying correction amount of the pattern array 1002, that is, the region C, is obtained as follows. Specifically, the default correction value of −60 dots for conveying a printing medium by the distance of 1280 nozzles (in the density of 9600 dpi) is converted into the correction value for conveying a printing medium in the distance of 512 nozzles (in the density of 1200 dpi). As a result, obtained is the value of "−24 dots (=−60 dots×512 nozzles/1280 nozzles)". Then, the pattern array 1002 is formed by subtracting this obtained value from the conveyance amount. At this time, the correction value stored when the patch C10 is selected remains −60 dots. In the meanwhile, when the patch C12 is selected, the correction is performed to increase the conveying length in the distance of 1 nozzle (1/1200 inches).

The value to be stored is obtained as follows. The value obtained by converting the distance of 1 nozzle (in the density of 1200 dpi) equal to 8 dots (in the density of 9600 dpi) to increase the conveying length into the distance of 1280 nozzles (in the density of 1200 dpi) into the correction value for conveying a printing medium by the distance of 512 nozzles (in the density of 1200 dpi) is "20 dots (=8 dots×1280 nozzles/512 nozzles)". Then, "−40" obtained by adding this value to the default value of "−60" is newly written and stored as the correction value for the region C. The conveying length of the region C in a real printing operation is always the distance of 64 nozzles in the density of 1200 dpi. The correction value of −40 dots set for the distance of 1280 nozzles (in the density of 1200 dpi) is converted into the correction value for conveying a printing medium in the distance of 64 nozzles in the density of 1200 dpi. Consequently, obtained is the value of "−2 dots (=−40 dots×64 nozzles/1280 nozzles)". This value is the correction value for the conveying length of 64 nozzles (in the density of 1200 dpi).

Next, description will be given of the adjustment (offsetting) of the correction value. As shown in FIG. 15, the offset amounts of the correction values for the regions B and C are set when the recoding medium is the "glossy medium" and the "mat medium". The offset amount is added to the default value or the above the correction value set on the basis of the test pattern, and the resultant value is used as the correction value in the real printing. As described above, the base materials of these printing media expand or contract by the application of ink. Taking this expansion or contraction into consideration, the adjustment values, that is, the offset amounts, are determined. Specifically, the offset amount in this embodiment is used to adjust the correction value (renew the correction value) for the region B or C in accordance with the expansion/contraction amount of the printing medium by the application of ink during printing. An predicted value based on an experiment or the like can be used as the offset amount.

A small amount of inks are applied to the printing medium in the formation of the test pattern. For this reason, the printing medium hardly expands or contracts in this case. In comparison to this, when a real halftone image in which beading is likely to appear is printed on the entire rear end region of the printing medium P, a relatively large amount of inks are applied thereon. Accordingly, the printing medium P is caused to expand, and the printing medium P is conveyed by the discharge roller 12 to a relatively small extent. The offset amount to eliminate this difference in the conveyance amounts is shown in FIG. 15. Now, description is given of the correction value for the region B. When the patch C12 is selected in the test pattern as in the above-described "photo glossy medium", the offset amount of 8 dots is added to −8 dots, and thereby the value of "0" is obtained. In other words, the printing medium P is conveyed by the distance of 288 nozzles (in the density of 1200 dpi). In the case of the region C also, when the patch C12 is selected in the test pattern, 20 dots is added to −40 dots and the value of −20 is obtained as the correction value. This correction value is converted into the correction value for conveying a printing medium in the distance 64 nozzles in the density of 1200 dpi. The correction value becomes −1 dot (−20 dots×64 nozzles/1280 nozzles=−1 dot).

As has been described above, in this embodiment, the correction is performed on the error due to the expansion/contraction amount of the printing medium itself in addition to the correction on the error in the conveyance amount by selection using the test pattern. Thus, the printing medium is conveyed with a high accuracy. Therefore, it is possible to reduce the image deterioration such as a stripe in comparison with a conventional technique.

Note that, although FIG. 15 shows the example of setting the correction value and the offset amount for each type of printing medium, the example may be altered. Alternatively, the correction value and the offset amount may be set for each size of printing medium and each printing quality in addition to the ones shown in the example in FIG. 15.

In addition, the procedure shown in FIG. 14A can be started by the user appropriately, can be started at an appropriate time in accordance with other conditions, or can be started in association with other processes.

For example, when the user selects a printing medium for printing, and starts the printing process, the printing may be executed without any instruction, if the correction amount and the offset amount have been set (stored) for the printing medium in advance. Otherwise, the user may be prompted to instruct the processes in FIG. 14A.

Moreover, the processes in FIG. 14A can be started with an operation unit in the printing apparatus, or may be started through a setting screen of the printer driver which is operated by the external device 1000 such as a computer.

Furthermore, the correction amount and the offset amount may be set in the printing apparatus, and for example stored in the EEPROM 103 of the printing apparatus. Alternatively, the correction amount and the offset amount may be set and stored in the printer driver of the external device 1000 such as a computer. In the latter case, when the external device 1000 supplies printing data or the like to the printing apparatus in the printing process, those data on the correction amount and the offset amount may be supplied with the printing data.

Other Embodiments

In the embodiment described above, the present invention is employed in the serial inkjet printing apparatus provided with the upstream conveying unit including the conveying roller and the downstream conveying unit including the discharge roller. However, it should be understood that any construction is included within the scope of the present invention as long as the construction sets a conveyance amount appropriate for an predicted shift of the printing position due to expansion or contraction of the printing medium, when a printing medium is released from the upstream conveying unit, and when the printing medium is conveyed by only the downstream conveying unit.

The expansion/contraction amount of the printing medium may vary in accordance with an environmental condition. Thus, a temperature sensor and a humidity sensor may be provided, for example, in the configuration in FIG. 2 in order to predict the amount of expansion/contraction of the printing medium, and to perform offsetting on a correction amount for each temperature-humidity region. Now, description will be given of an embodiment including a temperature-humidity sensor capable of measuring temperature in the unit of 1° C. and humidity in the unit of 1%.

FIG. 16 is a table showing parameters of a conveyance-amount correction in the embodiment including the temperature-humidity sensor. In this embodiment, a region whose temperature and humidity are measured is divided into three temperature-humidity regions: a low-temperature, low-humidity region (14° C. or below, 39% or below); a normal temperature region (15° C. to 25° C., 40% to 60%); and a high-temperature, high-humidity region (26° C. or above, 61% or above). Then, the offset amount is set for each region. Thus, as shown in FIG. 16, for the "glossy medium" and the "mat medium" which are likely to expand or contract due to the application of ink, the offset amounts are set larger in the low-temperature, low-humidity region than those in the other regions. Specifically, in the low-temperature, low-humidity region, the water content in the "glossy medium" or the "mat medium" is small and thus the printing media contract. Accordingly, since the extent of the expansion upon the application of ink becomes larger, the offset amounts are set larger. In contrast, in the high-temperature, high-humidity region, the water content is large, and thus the printing media expand. Accordingly, the extent of the expansion upon the application of ink becomes smaller. For this reason, the offset amounts are set smaller.

In this way, the correction is performed on the error due to the expansion/contraction amount of the printing medium itself and the temperature-humidity environment in addition to in addition to the correction on the error in the conveyance amount by setting using the test pattern. Thus, the printing medium is conveyed with a higher accuracy.

Furthermore, the printing apparatus according to the present invention may include a counter, which counts the number of dots formed on the rear end region of a printing medium, in order to predict expansion or contraction of the printing medium. Then, the offsetting may be performed on a correction value for each amount of inks applied to the rear end region of the printing medium.

FIG. 17 is a table showing parameters of a conveyance-amount correction in an embodiment including a counter (may be software or hardware) which counts the amount of inks. In FIG. 17, the maximum amount of inks, which can be applied to the rear end region of the printing medium, is shown as 100%. An offset amount of a correction value is determined on the basis of a ratio to the maximum amount. Here, the rear end region indicates a region, of the printing medium P shown in FIG. 6, upstream from the nip position of the discharge roller 12 and the spur 13. In other words, the rear end region is the region which expands or contracts due to the application of ink to the printing medium P, and the expansion or contraction affects the conveying of a part of the printing medium P corresponding to the regions B and C.

As shown in FIG. 17, as for each of the "glossy medium" and the "mat medium" which are likely to expand or contract due to the application of ink, when the amount of inks applied to the rear end region thereof is 0% to 19%, the resultant correction value is almost the same as the value set with the test pattern. Thus, the offset amount is set 0. Meanwhile, when the amount of inks applied to the rear end region is 20% to 50%, the amount of expansion of these printing media becomes larger. Thus, a larger offset amount is set. Moreover, when the amount of inks applied to the rear end region is 51% to 100%, the amount of expansion becomes far larger. Thus, a far larger offset amount is set.

As described above, the correction is performed on the error due to the expansion/contraction amount of the printing medium itself according to the amount of inks applied to the rear end region of the printing medium, in addition to the correction on the error in the conveyance amount by setting using the test pattern. Thus, the printing medium is conveyed with a higher accuracy.

Furthermore, the offset amount may be set by combining the correction of the error due to the expansion/contraction amount in accordance with the temperature-humidity environment and the correction of the error due to the expansion/contraction amount of the printing medium itself according to the amount of inks applied to the rear end region of the printing medium, in addition to the correction on the error in the conveyance amount by setting using the test pattern. Thus, the printing medium is conveyed with a higher accuracy.

Moreover, in the above-described embodiments, the rear end region of the printing medium is divided into: the region B where the printing is performed when the first conveying state is switched to the second conveying state; and the region C where the printing is performed after the switching. Then, the correction value of the conveyance amount or the offset amount is used for each of the corresponding regions. Nevertheless, it is only necessary to effectively suppress image deterioration due to the conveying error of the printing medium when or after the first conveying state is switched to the second conveying state. In other words, it is not necessary to divide the rear end into the plural regions, and to use the correction value or the offset amount for each of the corresponding regions. As long as the object of the present invention to effectively suppress image deterioration due to a conveying error is achieved, the same correction value or offset amount may be used for the rear end of the printing medium. Alternatively, the correction value or the offset amount may be used for any one of the regions B and C.

Still furthermore, it is needless to say that the types of the printing medium and the various values described in the embodiments are only exemplary, and that the present invention is not limited to these.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-036803, filed Feb. 16, 2007, which is hereby incorporated by reference herein in its entirety.

What is claimed is:

1. An inkjet printing apparatus, for conveying a plurality of types of printing media along a conveying path, and performing printing on the printing medium with a printing head at a printing position set on the conveying path, the inkjet printing apparatus comprising:

an upstream conveying unit arranged upstream of the printing position to convey the printing medium;

a downstream conveying unit arranged downstream of the printing position to convey the printing medium;

a correction section which corrects a conveyance amount of the printing medium when a first conveying state is switched to a second conveying state and after the first conveying state is switched to the second conveying state, the first conveying state being where the printing medium is conveyed by the upstream conveying unit and the downstream conveying unit, and the second conveying state being where the printing medium released from the upstream conveying unit is conveyed by only the downstream conveying unit; and an adjustment section which adjusts a first corrected value of the conveyance amount used by the correction section when the first conveying state is switched to the second conveying state and which adjusts a second corrected value, different from the first corrected value, of the conveyance amount used by the correction section after the first conveying state is switched to the second conveying state by using adjustment values which are set based on an expansion/contraction amount in accordance with a type of the printing medium during printing.

2. An inkjet printing apparatus as claimed in claim 1, wherein the correction and the adjustment are performed suited to a region on the printing medium which is printed when the first conveying state is switched to the second conveying state, and to a region on the printing medium which is printed after the switching.

3. An inkjet printing apparatus as claimed in claim 1, wherein the conveyance amount by the downstream conveying unit is greater than that by the upstream conveying unit, and the downstream conveying unit conveys the printing medium while allowing the printing medium to slip in the first conveying state.

4. An inkjet printing apparatus as claimed in claim 1, wherein the correction and the adjustment are performed in accordance with an environmental condition including at least one of temperature and humidity.

5. An inkjet printing apparatus as claimed in claim 1, wherein the correction and the adjustment are performed in accordance with the amount of inks applied on the printing medium.

6. An inkjet printing apparatus as claimed in claim 1, further comprising a test-pattern-printing control section which prints, on the printing medium, a test pattern for selecting the corrected values.

7. An inkjet printing apparatus as claimed in claim 6, further comprising:

a memory which stores values for performing the correction and the adjustment in accordance with the type of the printing medium; and a section to which the type of the printing medium is inputted when the test pattern is printed, wherein the test-pattern-printing control section prints the test pattern in accordance with the input, and the memory is for updating and storing the values in accordance with the selection.

8. A control method for an inkjet printing apparatus, for conveying a plurality of types of printing media along a conveying path, and which performs printing on the printing medium with a printing head at a printing position set on the conveying path, and which includes an upstream conveying unit arranged upstream of the printing position to convey the printing medium and a downstream conveying unit arranged downstream of the printing position to convey the printing medium, the control method comprising the steps of:

correcting a conveyance amount of the printing medium when a first conveying state is switched to a second conveying state and after the first conveying state is switched to the second conveying state, the first conveying state being where the printing medium is conveyed by the upstream conveying unit and the downstream conveying unit, and the second conveying state being where the printing medium released from the upstream conveying unit is conveyed by only the downstream conveying unit; and adjusting a first corrected value of the conveyance amount used in the correction step when the first conveying state is switched to the second conveying state and a second corrected value, different from the first corrected value, of the conveyance amount used by the correction section after the first conveying state is switched to the second conveying state by using adjustment values which are set based on an expansion/contraction amount in accordance with a type of the printing medium during printing.

* * * * *